US007140339B1

(12) United States Patent
Smith

(10) Patent No.: US 7,140,339 B1
(45) Date of Patent: Nov. 28, 2006

(54) FOOT OPERATED ELECTRIC STARTER MODIFICATION KIT

(76) Inventor: Bruce Francis Smith, 28 E. Renwick Rd., Plainfield, IL (US) 60544

( * ) Notice: Subject to any disclaimer, the term of this patent is extended or adjusted under 35 U.S.C. 154(b) by 0 days.

(21) Appl. No.: 11/385,375

(22) Filed: Mar. 21, 2006

(51) Int. Cl.
*F02N 11/08* (2006.01)

(52) U.S. Cl. ..... 123/179.3; 123/179.24

(58) Field of Classification Search ..... 123/179.3, 123/179.24, 185.1, 185.14, 198 C, 198 E
See application file for complete search history.

(56) References Cited

U.S. PATENT DOCUMENTS 1,557,418 A * 10/1925 Chilton ..... 290/1 C
3,533,389 A * 10/1970 Harker ..... 123/179.24
3,830,213 A * 8/1974 Herman ..... 123/198 DB
4,883,028 A * 11/1989 Wu ..... 123/179.3
5,497,739 A * 3/1996 Muller ..... 123/185.6
5,662,195 A 9/1997 Rush
6,109,121 A 8/2000 Brown
6,420,680 B1 * 7/2002 Samodell ..... 219/132
6,637,395 B1 10/2003 Olson et al.

* cited by examiner

*Primary Examiner*—Stephen K. Cronin
*Assistant Examiner*—Arnold Castro
(74) *Attorney, Agent, or Firm*—Stephen Z. Weiss

(57) ABSTRACT

A kick start switch modification kit and method for modifying an electric starter system on a motorcycle to a foot-operated electric starter simulating the classic foot operated kick start mechanism. Novel components which are contained in the modification kit include a foot pedal assembly, a rotating shaft, a switch engaging cam, a limit switch and a cover body having screw holes through which fasteners can pass which fasteners are in turn screwed into the cycle body where the classic kick start mechanism would be located.

7 Claims, 6 Drawing Sheets

FOOT OPERATED ELECTRIC STARTER MODIFICATION KIT

FIELD OF THE INVENTION

The present invention relates generally to a kick start switch modification kit for an electric starter system. More particularly, the present invention is a kit for modifying an electric starter in newer model Harley Davidson motorcycles having an electric starter system, to a foot operated electric starter switch simulating the older classic foot operated kick start. The kick start modification kit can also be adapted to modify other motorcycles which have an electric starter system to a foot operated electric starter switch. The present invention is also directed to the novel component pieces contained in the kit which are required to complete the modification.

BACKGROUND OF THE INVENTION—DESCRIPTION OF THE PRIOR ART

Electric starters for initiating internal combustion engines are well known, and primarily consist of an electrically powered motor which through gearing mechanisms rotate the crankshaft of an engine from rest up to a rate of revolution at which the engine will commence to operate on its own. The power for the starter is supplied by the vehicle battery. The starter is designed to produce a high power output or torque over a short period of time without exceeding a specified temperature, so that the static inertia and friction inherent in the engine are quickly overcome. Most vehicles with internal combustion engines, such as automobiles, trucks and motorcycles, are provided with starters so that manual starting is not necessary.

Many vintage motorcycles, however, were not built with electric starters. To crank the engine, a kick pedal was provided which the rider had to forcibly move over a partial rotation path. The kick pedal was connected to the kick shaft which was connected through a clutch and gearing or chain mechanisms to the crankshaft. When the rider forced the kick pedal downward, the crankshaft was rotated and the pistons were moved causing the engine to start.

Kits have been provided to modify systems or relocate controls on motorcycles. One such kit is disclosed in U.S. Pat. No. 6,109,121. This kit allows a kick start only starter system to be modified to an electric starter system with the addition of an electric motor. Another kit is disclosed in U.S. Pat. No. 6,637,495 which adds a kick start foot pedal assembly to an existing motor drive shaft. This foot pedal assembly assists in the start of an engine having an electric starting motor. Because it must be fixed to the motor drive shaft, attaching this device to the motorcycle is somewhat complicated. Still another kit is disclosed in U.S. Pat. No. 5,661,195 which modifies a foot operated shift mechanism and a hand operated clutch to a foot operated clutch and a hand operated shift mechanism. All of these kits, although claiming to be simple to install, are in fact very complicated because of their being integrated into the basic elements of each system.

Currently, there is a desire by motorcycle owners, particularly the owners of Harley Davidson motorcycles, to modify their current model motorcycles to resemble the older model Harley Davidson motorcycles with simulated foot operated kick start mechanisms where the installation of a modification kit that is very simple. Therefore, it is an object of this invention to provide a kit that will allow the simple installation of a foot operated electric switch assembly for an electric motorcycle starter, where the starter switch assembly simulates the feel and appearance of the classic kick starter and can be easily mounted onto the motorcycle in a generally unobtrusive manner without requiring any major readjustment or alteration of the structure of the motorcycle. This assembly can be easy enough to install by the average motorcycle enthusiast or installed during manufacture by the factory

SUMMARY OF THE INVENTION

The invention is a kit for modifying a hand button activated electrical starter system to a foot activated kick start switch assembly simulating the classic kick start motorcycle. The kit includes a cover body held to the motorcycle housing and a rotating shaft rotatably mounted to the cover body. A pedal assembly is fixed to one end of the rotating shaft and an operating cam is fixed to the opposite end of the rotating shaft. Biasing means maintains the pedal assembly and rotating shaft in a preset at rest position and helps to resist a force placed by a foot on the pedal assembly. A switch assembly fixed to the cover body is contacted by a portion of the operating cam when the pedal assembly, rotating shaf,t and operating cam are moved to a preset actuating position.

DETAILED DESCRIPTION OF THE INVENTION

Figure 1:
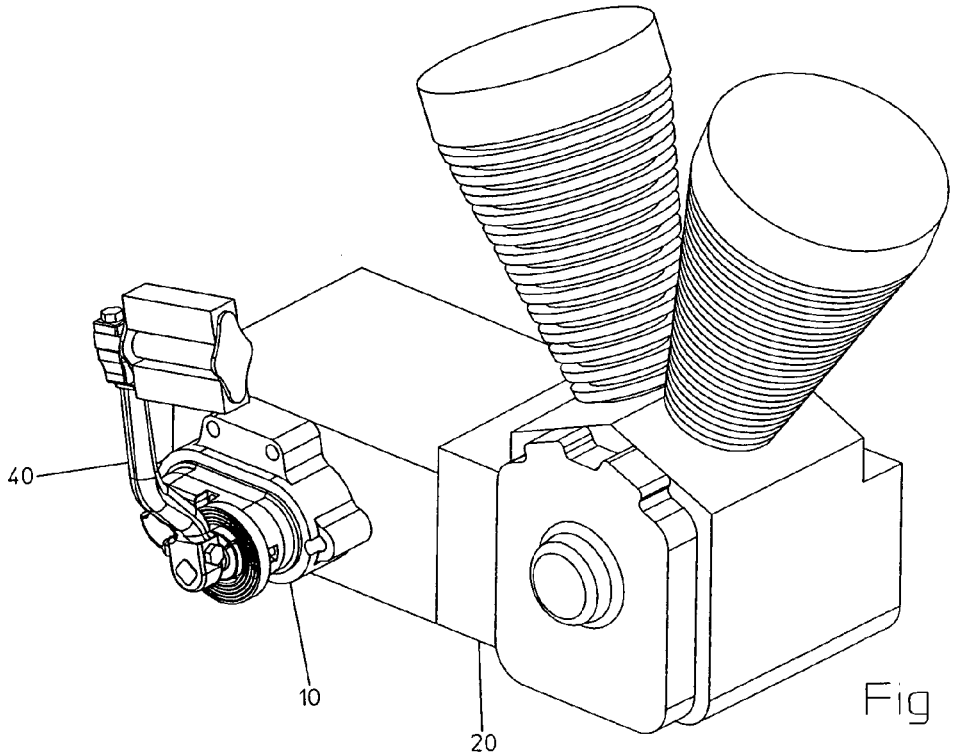
FIG. 1 is a front perspective exploded view of the invention in the at rest position and a partial view of the motorcycle to which it is to be mounted.

With reference to the drawings, the invention will now be described in detail with regard the preferred embodiment. The invention is a modification kit 10 which is easily mounted unobtrusively onto the exterior transmission cover of a motorcycle. This kit enables the motorcycle starter motor relay to be activated by using a motion that replicates that of a classic manual kick start motorcycle. The assembly can be retrofitted to Harley Davidson or other brand of motorcycles to achieve a nostalgic appearance. The kit comprises in general, a cover body 11 held to the motorcycle housing 20, a rotating shaft 30 rotatably mounted to the cover body, a pedal assembly 40 fixed to one end of the rotating shaft, an operating cam 50 (FIG. 3) fixed to the opposite end of the rotating shaft, biasing means 60 maintaining the pedal assembly and rotating shaft in a preset at rest position, and a switch assembly 70 (FIG. 3) fixed to the cover body which is contacted by a portion of the operating cam when the pedal assembly, rotating shaft, and operating cam are in a preset actuating position.

Figure 2:
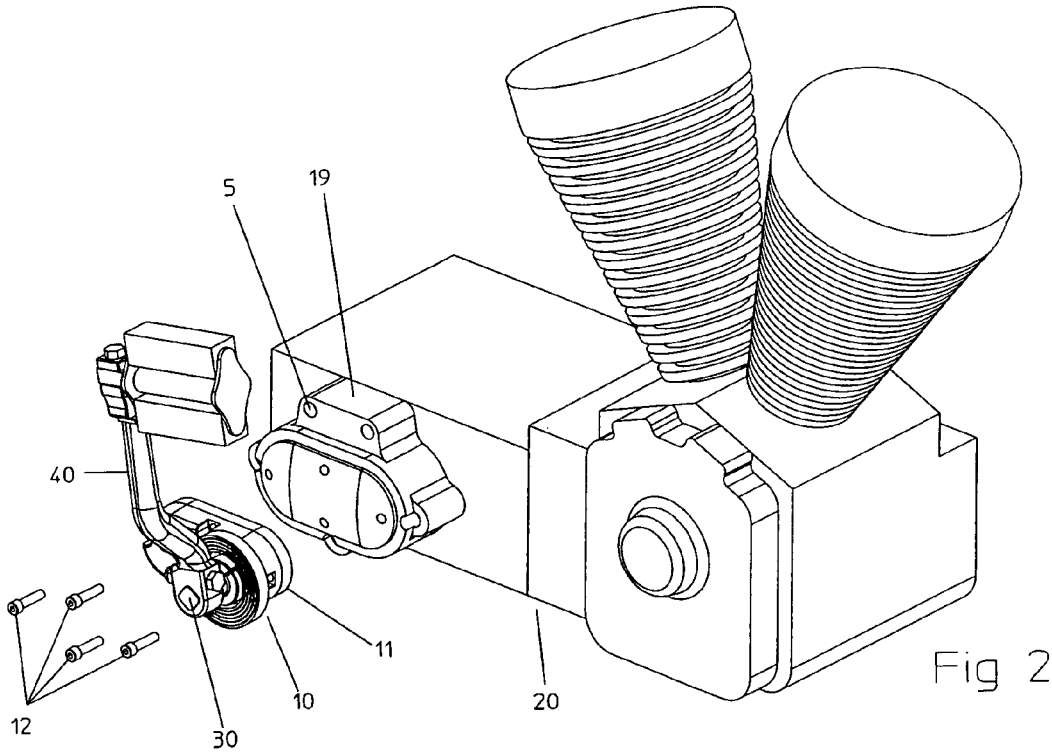
FIG. 2 is a front perspective view of the invention in FIG. 1 fixed to the motorcycle.
Figure 11:
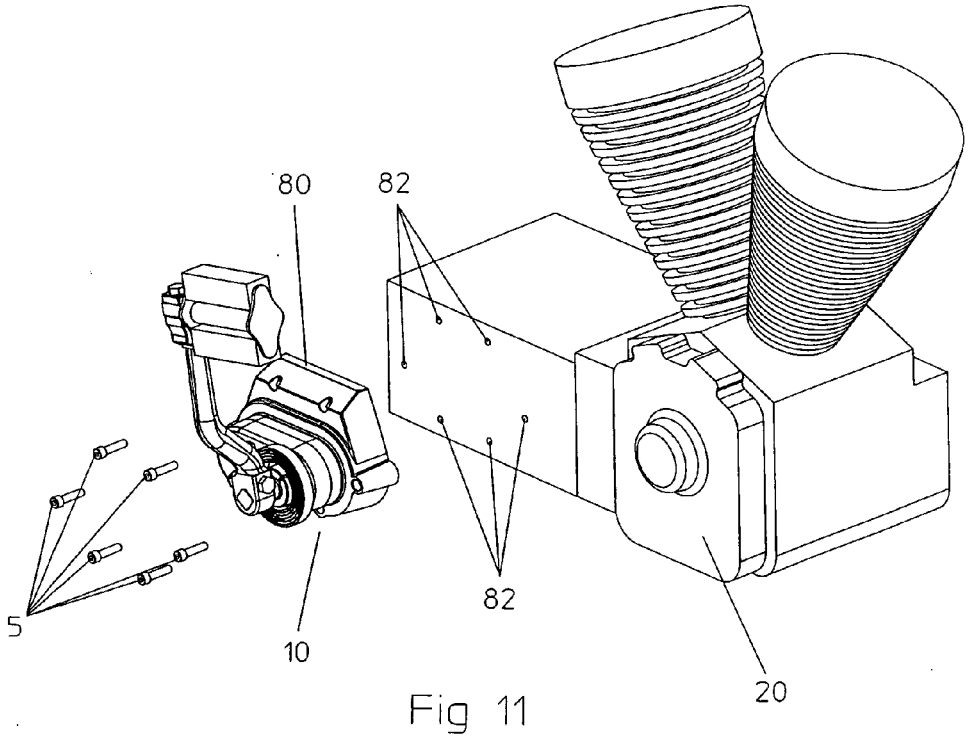
FIG. 11 is a partial exploded view of an alternative embodiment of the invention.

As shown in FIGS. 1 and 2, the modification kit is fixed to the motorcycle housing with four mounting screws 12 passing through four holes in the cover body 11. The cover body is placed over an existing cover 19 on the motorcycle body. A drilling template, not shown, will provide locations for the new drilled and threaded holes, to be formed in existing cover 19, to which the mounting screws 12 may be fastened. In an alternate embodiment, as shown in FIG. 11, the cover body can include a new cover 80 which replace the existing cover 19 on the existing motorcycle body so that the existing screws 5 used to hold the existing cover 19 can be threaded into existing tapped holes 82 in the motorcycle housing so that new threaded holes in the motor cycle body will not have to be prepared.

Figure 4:
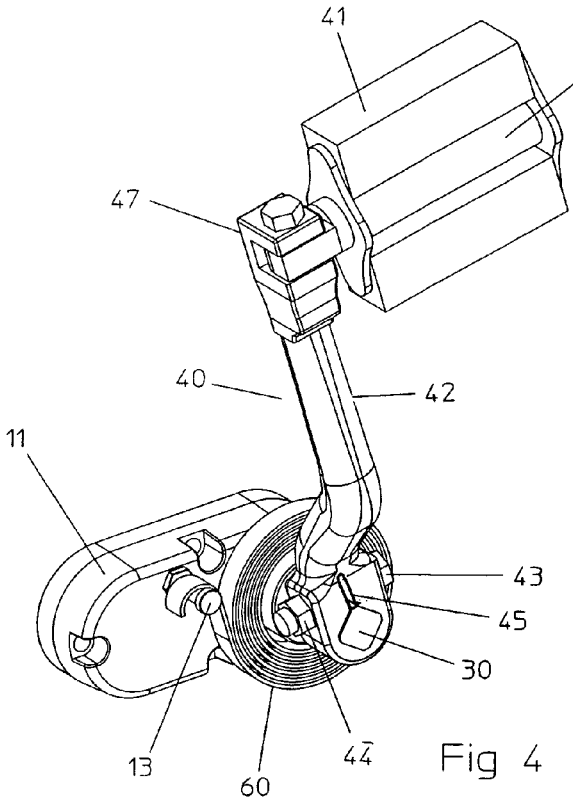
FIG. 4 is a front perspective view of the invention in the at rest position.
Figure 3:
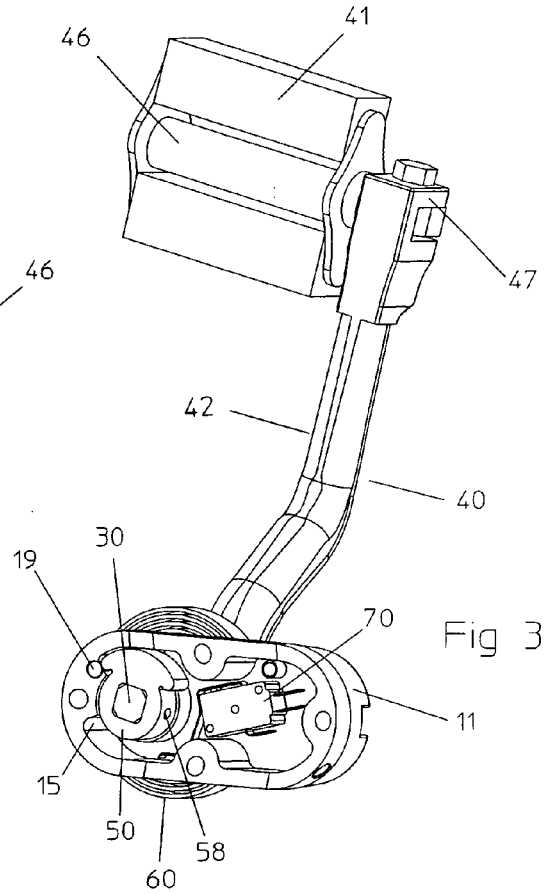
FIG. 3 is a rear perspective view of the invention in the at rest position.
Figure 5:
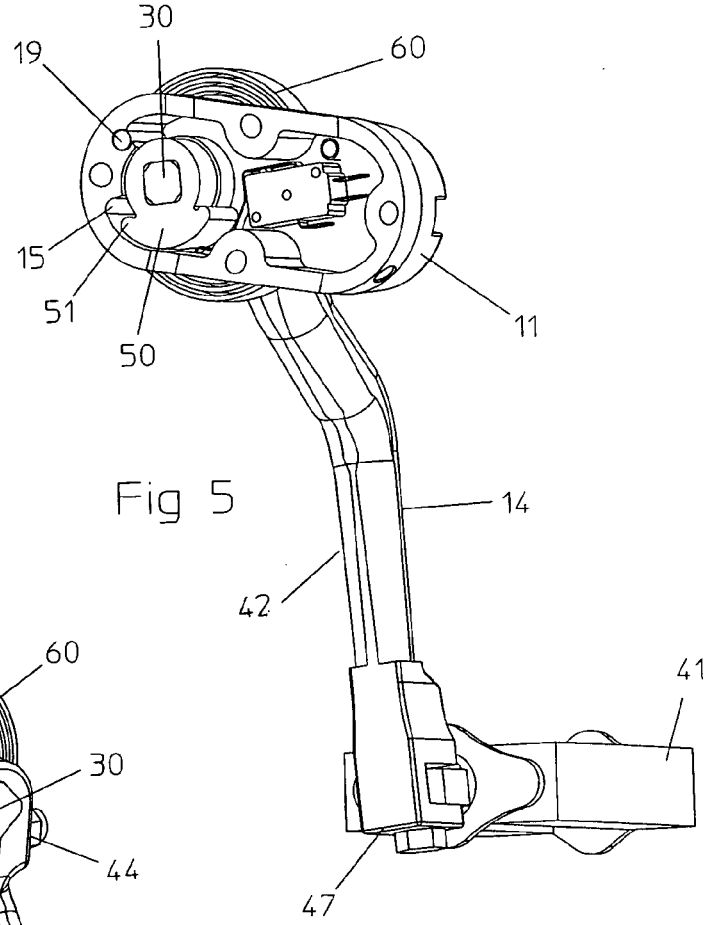
FIG. 5 is a rear perspective view of the invention in the actuation position where the limit switch is closed in the full switched position.
Figure 6:
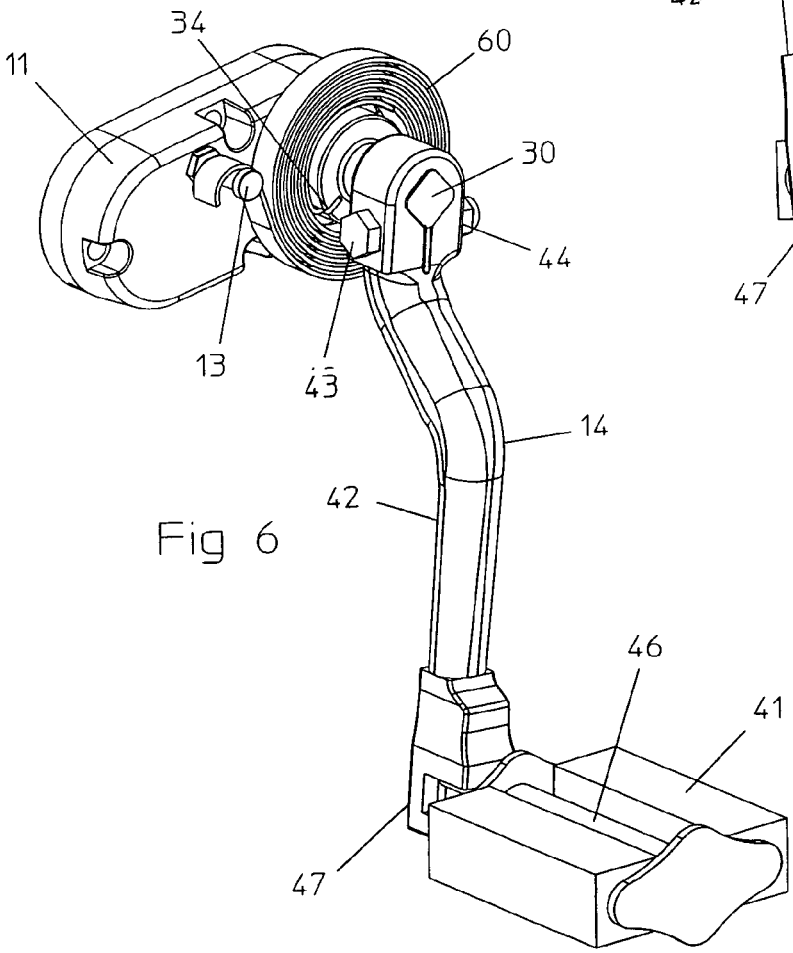
FIG. 6 is a front perspective view of the invention in the actuation position.

The pedal assembly 40 as shown in FIGS. 3 through 6 includes a pedal 41 held to a first end of a pedal arm 42. A second end of the pedal arm opposite the first end is fixed to the rotating shaft 30. To help secure and remove the pedal arm 42 to and from the rotating shaft 30, the second end of the pedal arm has a somewhat bendable opening 45. The bendable opening is forced into closer mechanical contact with the rotating shaft when the nut 44 is screwed into bolt 43. The pedal 41 is normally biased into an at rest position so that the pedal shaft 46 is parallel to the motorcycle housing 20, as shown in FIGS. 3 and 4. When a foot is placed on the pedal 41, the foot overcomes the pedal biasing assembly 47 allowing the pedal shaft 46 to be perpendicular to the motorcycle body, as shown in FIGS. 5, 6 and 10.

To keep the pedal assembly in the pre set at rest position, biasing means 60 in the form of a torsion spring is provided. One end of the torsion spring 60 is fixed to a groove 34 in the rotating shaft 30. The other end of the torsion spring 60 has a hook that is hooked onto a spring stud 13 fixed to cover body 11. The biasing means serves a further purpose of countering the force placed on the foot pedal as will be explained later.

Figure 10:
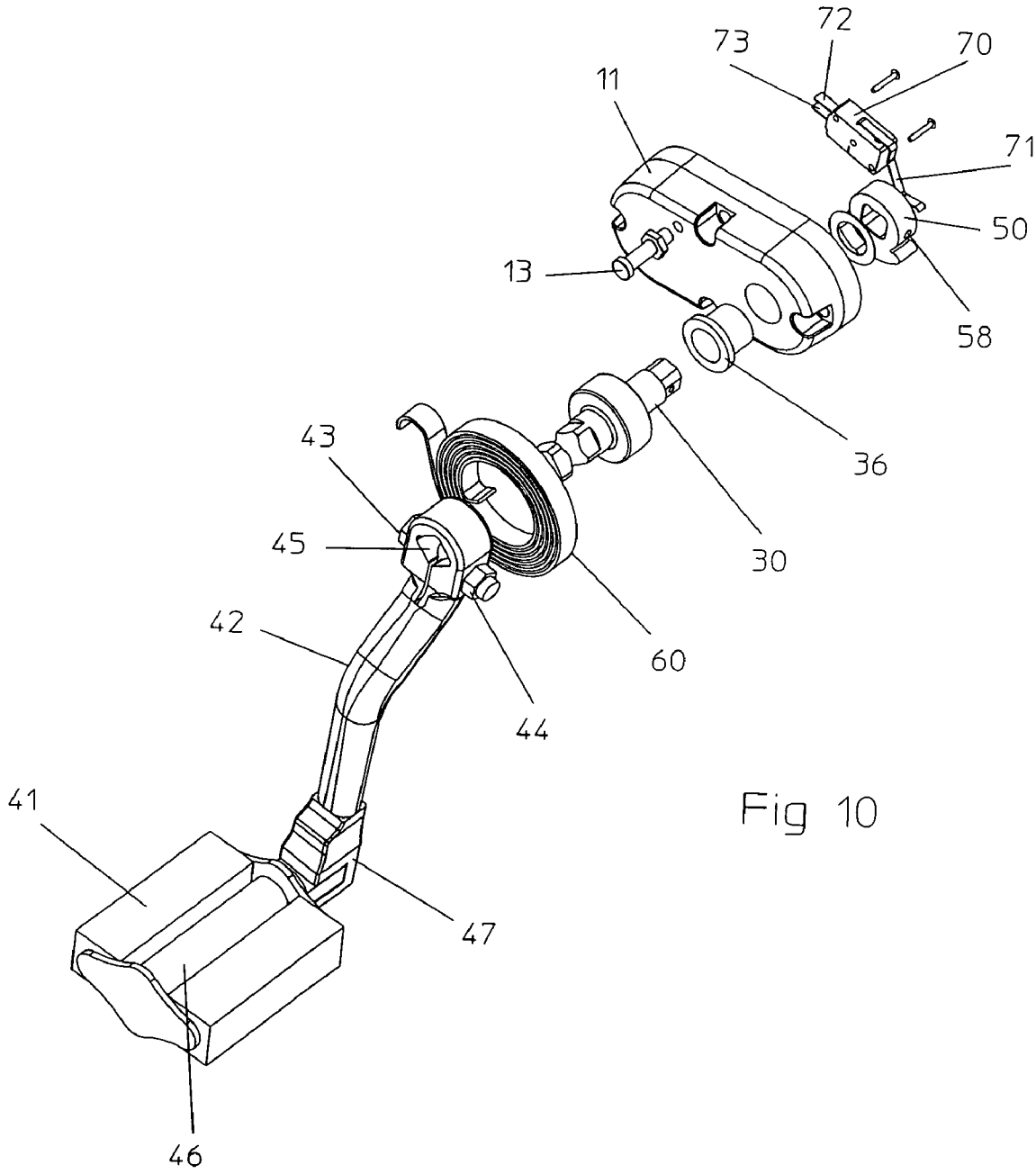
FIG. 10 is an exploded perspective view of the component parts of the invention.

As shown in FIG. 10, the rotating shaft 30 is allowed to freely rotate within the cover body 11. A portion of the shaft rotatingly moves within a bushing 36 which is located in a bushing aperture 17 in the cover body 11. The operating cam 50 is fixed to the end of the rotating shaft opposite the end to which the pedal assembly is fixed. An opening 56 in the operating cam 50 slides over the end of the rotating shaft 30. A set screw 58, passing through the operating cam 50, prevents the operating cam from slipping off the rotating shaft.

Figure 7:
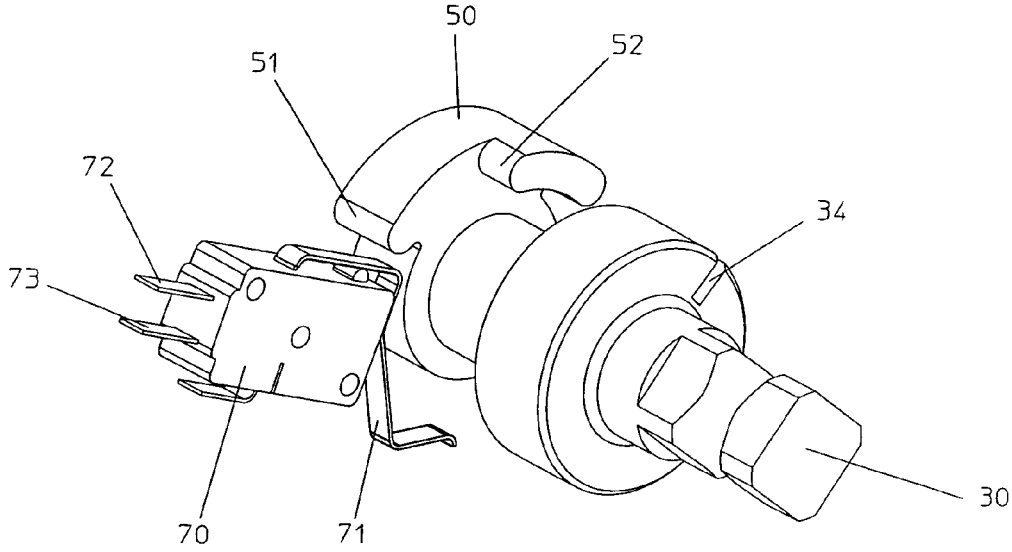
FIG. 7 is a detail perspective view of the actuation cam and the limit switch in the at rest position.
Figure 8:
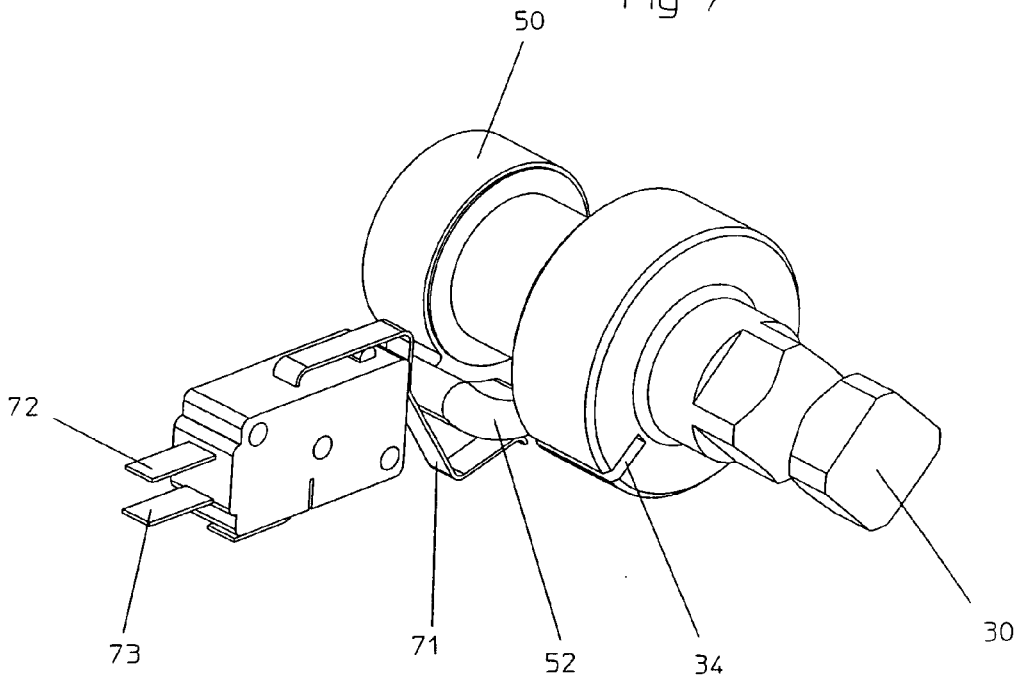
FIG. 8 is a detail perspective view of the actuation cam and the limit switch in the actuation position where the cam contacts the switch.

As best shown in FIG. 7, the operating cam 50 has a stop lobe 51 and a switch actuating lobe 52. In the at rest position, as shown in FIGS. 3 and 7, the switch actuation lobe 52 is out of engagement with the actuation lever 71 of the switch assembly 70. A first end of the rotating stop lobe 51 is in engagement with a rubber stop cushion 19 fixed in an inner face of the cover body 11. This cushion absorbs some of the force when the pedal assembly 40, rotating shaft 30 and operating cam 50 are moved together by the biasing spring 60 from the actuation position, as shown in FIGS. 5 and 8, to the at rest position, as shown in FIGS. 3 and 7.

FIG. 5 shows the pedal assembly 14 in the actuation position after a force is placed on the pedal 41 causing the rotating shaft 30 and operating cam 50 to move to the actuation position. In this position, as shown in FIG. 8, the switch actuation lobe 52 engages the actuation lever 71 closing the starter circuit thereby actuating the starter system. As the switch actuation lobe 52 moves toward the actuation lever 71, the biasing spring 60 is being wound up, as shown in FIGS. 5 and 6, thereby providing an increasing force countering the force placed on the pedal 41 by a foot. If the force is too great, the operating cam 50 will continue to move until the stop lobe 51 engages a stop slot 15 on an inner surface of the cover body 11.

Figure 9:
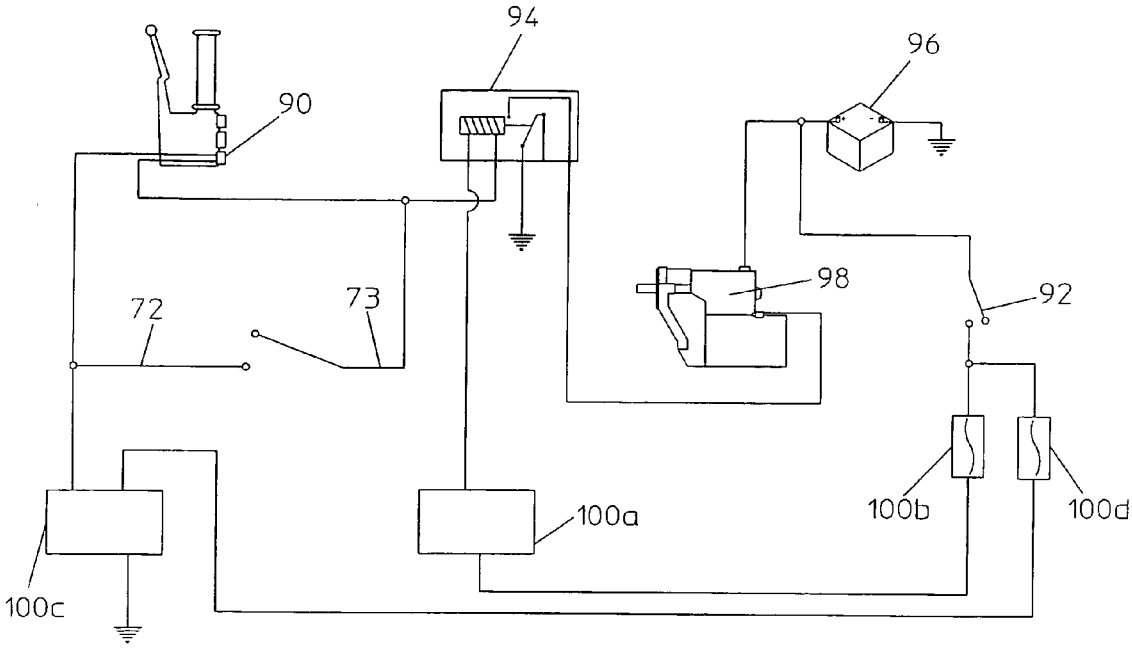
FIG. 9 is a schematic drawing of the electrical system with the new modification kit.

FIG. 9 shows a schematic of the existing starter system and with the location of where the wires coving from leads 72 and 73 of the switch assembly from the kit are attached. The switch assembly 70 of the invention has two wires 72 and 73. Each wire is electrically fixed to a respective wire leading from the existing starter switch 90. With the ignition switch key 92 closed and with either the starter switch 90 or the kick start switch assembly 70 closed, the starter relay 94 switch closes with current passing through the ignition module 100*c* and fuse 100*d* which are already part of the existing electrical system. The closed starter relay switch 94 allows current from the battery 96 to flow to the starter motor 98 with the current also passing through a relay control 100*a* and fuse 100*b*.

The sequence of operation for the invention is described in the following actions. A force on the kick pedal 41 rotates the rotating shaft 30 from the at rest position to the actuation position whereby the actuation lobe 52 on the actuation cam 50 engages the actuating lever 71 on the switch assembly 70. The switch will close and activate the original equipment starter circuit and energize the motor 98. With continued force on the kick pedal 41, the rotating shaft 30 will continue until the stop lobe 51 of the operating cam 50 engages the stop slot 15 in the cover body 11 which will stop forward movement of the kick pedal. This action simulates a mechanical kick started motorcycle. After the motorcycle has started, the pedal assembly 14 is allowed to return to at rest position with the release of foot pressure on the foot pedal 41 which allows the torsion spring 60 to provide a return force. The return force is absorbed and dampened by the stop lobe 51 striking a rubber stop cushion 19 retained in the cover body 11.

It is understood and contemplated that certain equivalents and substitutions for elements set forth above may be obvious to those skilled in the art, and the true scope and definition of the invention therefore is to be as set forth in the following claims.

The invention claimed is:

1. A motorcycle kick start modification kit for modifying a hand button activated electrical motorcycle electrical engine starter system to a simulated kick start starter comprising:

a cover body mountable onto a portion of the motorcycle;

a rotating shaft rotatably fixed to and extending outwardly from the cover body;

a foot pedal assembly coupled to the foot pedal shaft, the foot pedal assembly designed to receive a force placed by a foot and transfer it to the rotating shaft;

a switch engaging cam fixed to the rotating shaft;

an electrical switch fixed to the body cover with leads electrically engageable to the electrical engine starter system;

the switch engaging cam movable from an at rest position, when the cam is out of engagement with the electrical switch, to an actuation position, when the cam engages the switch; and means for biasing the rotating shaft so that the switch engaging cam is in the at rest position when no force is placed on the foot pedal assembly and for providing increased force against the force placed by the foot as the switch engaging cam is moved toward the actuation position where the switch engaging cam engages the switch to activate the electric starter system.

2. The motorcycle kick start convention kit according to claim 1 wherein the switch engaging cam further includes a rotation stop lobe which engages a rotation stop seat in the cover to stop the movement of the switch engaging cam from moving beyond a pre set position.

3. The motorcycle kick start convention kit according to claim 1 wherein the electrical switch has an actuation lever which is engaged by an outer surface of an switch actuation lobe on the switch engaging cam.

4. The motorcycle kick start modification kit according to claim 1 wherein the mounting cover includes cover holes through which fasteners may pass, the cover holes being in alignment with holes in the body of a motorcycle.

5. The motorcycle kick start modification kit according to claim 4, further comprising a template for drilling holes in the motorcycle body which holes are in alignment with the cover holes in the cover body.

6. The motorcycle kick start modification kit according to claim 4, wherein the mounting cover replaces a portion of the motorcycle body.

7. A method for modifying an electric starter system to a simulated kick starter system, comprising the steps of:

a) mounting a kit start modification kit onto a portion of the motorcycle, the kick start modification kit comprising:

a cover body mountable onto a portion of the motorcycle;

a rotating shaft rotatably fixed to and extending outwardly from the cover body;

a foot pedal assembly coupled to the rotating shaft, the foot pedal assembly designed to receive a force placed by a foot and transfer it to the rotating shaft;

a switch engaging cam fixed to the rotating shaft;

an electrical switch fixed to the body cover with leads electrically engageable to the electrical engine starter system;

the switch engaging cam movable from an at rest position, when the cam is out of engagement with the electrical switch, to an actuation position, when the cam engages the switch; and means for biasing the rotating shaft so that the switch engaging cam is in the at rest position when no force is placed on the foot pedal assembly and for providing increased force against the force placed by the foot as the switch engaging cam is moved toward the actuation position where the switch engaging cam engages the switch to activate the electric starter system, and b) connecting the leads of the electrical switch to the electrical starter system.

* * * * *